US007302777B1

(12) United States Patent
Sugranes Arimany

(10) Patent No.: US 7,302,777 B1
(45) Date of Patent: Dec. 4, 2007

(54) SWIMMING POOL AND ITS BUILDING PROCEDURE

(75) Inventor: Marcelino Sugranes Arimany, Barcelona (ES)

(73) Assignee: Ceramica Sugranes S.A., Barcelona (ES)

( * ) Notice: Subject to any disclaimer, the term of this patent is extended or adjusted under 35 U.S.C. 154(b) by 0 days.

(21) Appl. No.: 11/440,471

(22) Filed: May 25, 2006

(30) Foreign Application Priority Data

May 23, 2006 (ES) ..... 200601343

(51) Int. Cl.
*E04H 4/04* (2006.01)

(52) U.S. Cl. ..... 52/169.7

(58) Field of Classification Search ..... 52/258, 52/169.7

See application file for complete search history.

(56) References Cited

U.S. PATENT DOCUMENTS 2,882,712 A * 4/1959 Carlson ..... 52/293.1

3,468,088 A * 9/1969 Miller ..... 52/250

FOREIGN PATENT DOCUMENTS

ES 434509 2/1975

* cited by examiner

*Primary Examiner*—John Kreck
(74) *Attorney, Agent, or Firm*—Pravel Intellectual Property Law, P.C.; James W. Pravel

(57) ABSTRACT

This swimming pool consists of a first sheet or layer of concrete (1) forming the foundation, on which general "C" profile prefabricated reinforced concrete parts (2*a*, 2*b*, 2*c*) are laid, which have tongues or clips (25, 26) projecting from the reinforcement, holes (22) to assemble side torque means (3, 31), vertical channels (23) which define a housing containing concrete filler (4) with expansive additives, and vertical bevels (24) to place sealing filler (5) of the joints. It also consists of a bed (6), which covers the front tongues or clips (25), an upper perimeter finish (7, 8) and a lining of tiles (9) applied directly on the prefabricated parts (2*a*, 2*b*, 2*c*) and the bed (6).

9 Claims, 4 Drawing Sheets

SWIMMING POOL AND ITS BUILDING PROCEDURE

FIELD OF THE INVENTION

This invention refers to a swimming pool, consisting of a side wall made up of prefabricated parts, and its building procedure.

BACKGROUND OF THE INVENTION

It is currently normal practice in building in ground swimming pools to first excavate in accordance with the height of the pool, and then place perimeter formwork to build the vertical walls by pouring in concrete.

These built swimming pools are more widely accepted on the market than prefabricated pools made of fibre or other synthetic materials owing to their high level of rigidity.

However, to build a pool by making the corresponding formwork and then pouring concrete and reinforcing if necessary, involves a series of inconveniences, such as the need for qualified builders, excessive time to build the pool and consequently high costs.

In this type of pool, possible errors in the verticality of the formwork and the risk of filtrations mean that an insulation lining is required on the inside surface of the pool plus extra cement on which to position the tiles that form the final inside surface of the pool.

These operations slow down and increase the cost of building a swimming pool.

The method of building a pool by using prefabricated concrete parts for the side walls is also known. This method reduces the time needed to build the pool as there is no formwork.

An example of this type of swimming pool is described in the invention U.S. Pat. No. 434,509 "Perfecting the construction of swimming pools with prefabricated concrete elements", in which in order to place these building elements or parts, corner upright posts must first be constructed between which horizontal support girders or elements must be placed forming a groove to bear the prefabricated parts forming the peripheral wall of the pool.

Although this building method eliminates the problem of making perimeter formwork, it does not ensure that the pool is sealed and means that it is still necessary to line the whole inside surface of the pool with a water-sealed lining.

SUMMARY OF THE INVENTION

The swimming pool, which is the object of this invention, consists of side walls formed by prefabricated concrete parts, the building characteristics of which are targeted at guaranteeing the correct fastening of said parts and guaranteeing that the joints of said parts are sealed without the need for a waterproof lining or extra cement on the inside surface of the pool.

Another aim of this swimming pool is to guarantee a minimum construction time by means of the procedure, which is also included in this invention, and to enable a lining of tiles to be applied directly on the surface of the prefabricated parts forming the side walls.

In accordance with the invention, this swimming pool consists of a first sheet or layer of concrete forming the foundation and which defines a horizontal surface to place prefabricated reinforced concrete and general "C" section parts, with reinforced tongues or clips which partially project from the front/lower areas and from the upper area of the prefabricated parts. These prefabricated parts have at least two vertically directed back ribs, matching the side ends, and have slightly horizontal holes in which side torque elements of the successive pairs of parts are placed, in order to link the different parts forming the side wall.

These prefabricated reinforced concrete parts also have vertical grooves on the opposite sides and which define between successive parts the housing for concrete filler with expansive additives, which increases the rigidity of the join between the successive parts, and vertical bevel surfaces which affect the edges defined by the front and side surfaces of the parts, forming two bevel surfaces of consecutive parts, a front notch in which sealing filler of the joint defined by the adjacent parts is placed.

The swimming pool also consists of a bed formed by a second layer of concrete placed on the first layer or sheet of concrete forming the foundation. This bed covers the reinforced clips or tongues, which project from the lower area of the prefabricated reinforced concrete parts, so that once the second layer of concrete has set, the tongues or clips of the prefabricated parts are embedded inside, guaranteeing a solid and permanent fastening and avoiding any involuntary movement.

This pool also consists of an upper perimeter finish of the side wall and a lining of tiles applied directly on the front surface of the prefabricated reinforced concrete parts and on the bed or bottom of the pool.

This perimeter finish can have fluted parts set on the prefabricated reinforced concrete parts, and which form a perimeter channel to collect water in the case of overflow pools, and a perimeter concrete ring placed behind the fluted parts, which covers the upper tongues or clips of the prefabricated reinforced parts, thereby reinforcing the join of these prefabricated parts and guaranteeing stability of the fluted parts.

The side tightening means of the successive pairs of prefabricated reinforced concrete parts consists of some threaded rods assembled as bushings on the holes of the back ribs adjacent to said prefabricated parts, and end lock nuts, which guarantee the side approach of the successive prefabricated parts and their initial fastening.

The prefabricated concrete parts, with the aforementioned specifications, can have different configurations to enable the side walls to be built in different sizes and configurations, having planned that some of these prefabricated parts should have a straight configuration to form the sides or straight sections of the pool, others should have a space inside to install the access ladder and others should have an angle configuration to form the corners of the pool.

These prefabricated concrete parts can have a step at an intermediate height, projecting towards the front or inside surface of the pool, which can have a wider indentation to form an access ladder.

This invention also contemplates a procedure to build the aforementioned swimming pool. Said procedure includes the following steps:

a) a flat foundation by applying a first layer of concrete.

b) placing prefabricated reinforced concrete parts on the set foundation, placed sideways to form the side surface of the pool.

c) linking and side tightening of successive pairs of prefabricated parts by inserting threaded rods and lock nuts in the holes of the back ribs.

d) filling the holes formed by the opposite vertical channels of the successive parts with concrete with expansive additives.

e) sealing the front joints of the prefabricated parts by applying a sealer filler in the side bevels of said prefabricated parts.

f) forming a bed or base of the pool by a second layer of concrete, to cover the front tongues or clips of the concrete parts, thereby reinforcing the join of the prefabricated parts.

g) upper finish of the pool by fastening fluted parts on the prefabricated parts forming the side wall, and building a perimeter ring with concrete on the upper tongues of the prefabricated parts.

h) lining the inside surface of the pool by placing tiles directly on the front surface of the prefabricated parts and the bed surface.

BRIEF DESCRIPTION OF THE DRAWINGS

To complement the description and in order to further understand the specifications of the invention, a set of drawings is attached to this descriptive report, in which the following has been represented, for illustrative, but not limitative purposes.

EMBODIMENTS AND MANUFACTURE OF THE INVENTION

In the example shown in the attached figures, the swimming pool consists of a sheet or layer of concrete (1), forming the foundation, on which general "C" profile, prefabricated reinforced concrete parts (2*a*, 2*b*, 2*c*) are placed, which when aligned and placed sideways, form the side wall of the pool.

Figure 2:
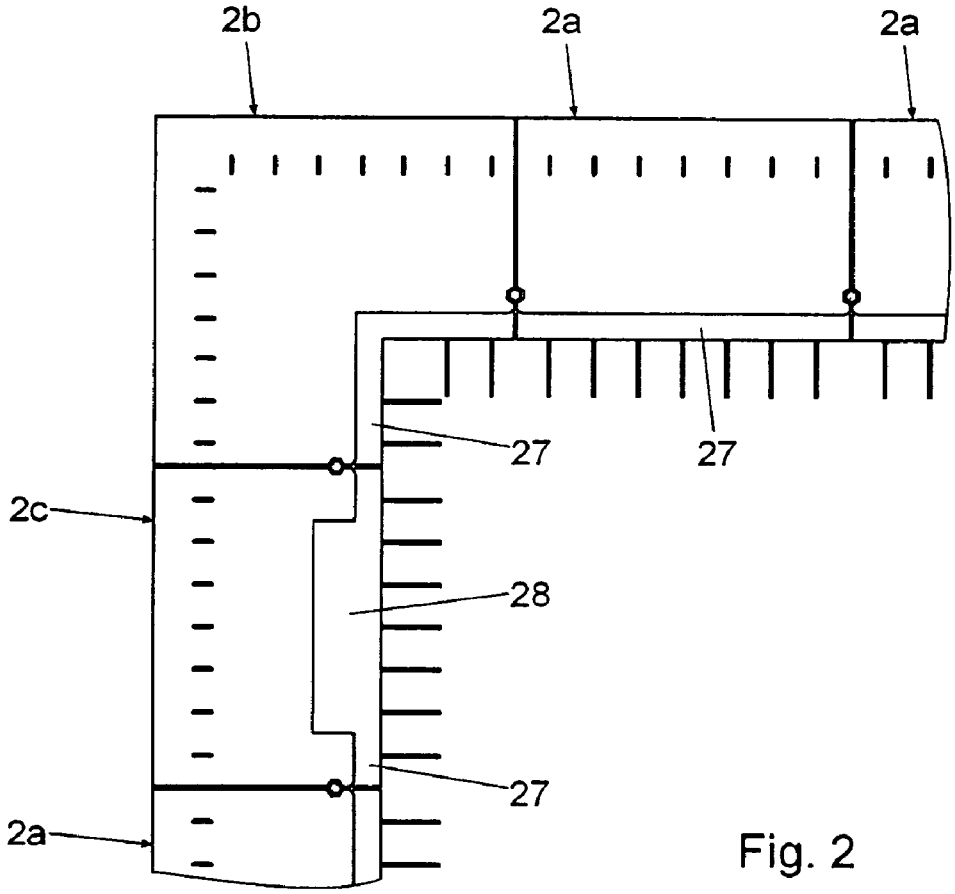
FIG. 2 shows an upper ground view of a corner portion of the side wall of the pool, in which a straight prefabricated part, a corner prefabricated part and a straight prefabricated part with wider step forming the access to the pool.

As can be observed in FIG. 2, the prefabricated parts (2*a*) have a straight configuration, parts (2*b*) have a corner configuration and parts (2*c*) are also straight and have a configuration suitable to forming an access ladder to the pool.

Figure 3:
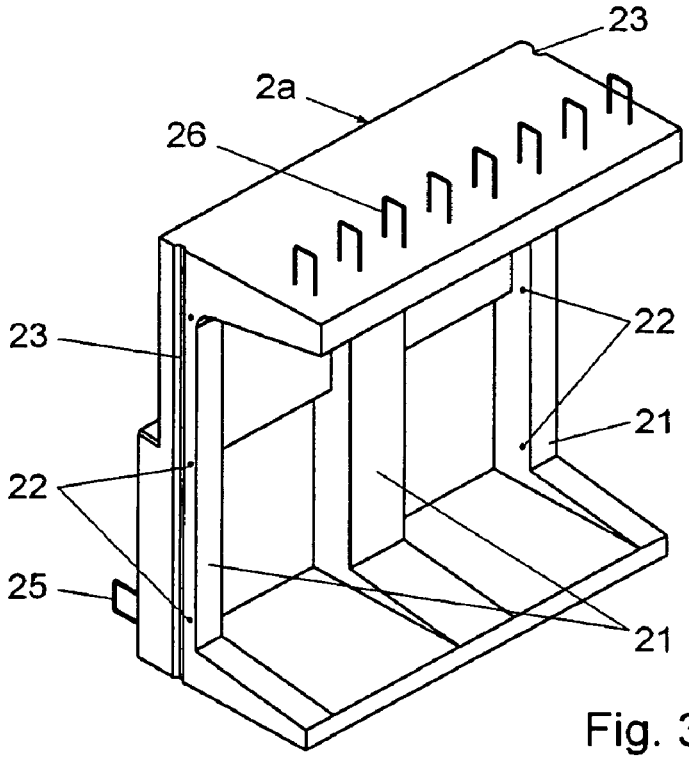
FIG. 3 shows an back elevation view of a straight prefabricated reinforced concrete part.
Figure 4:
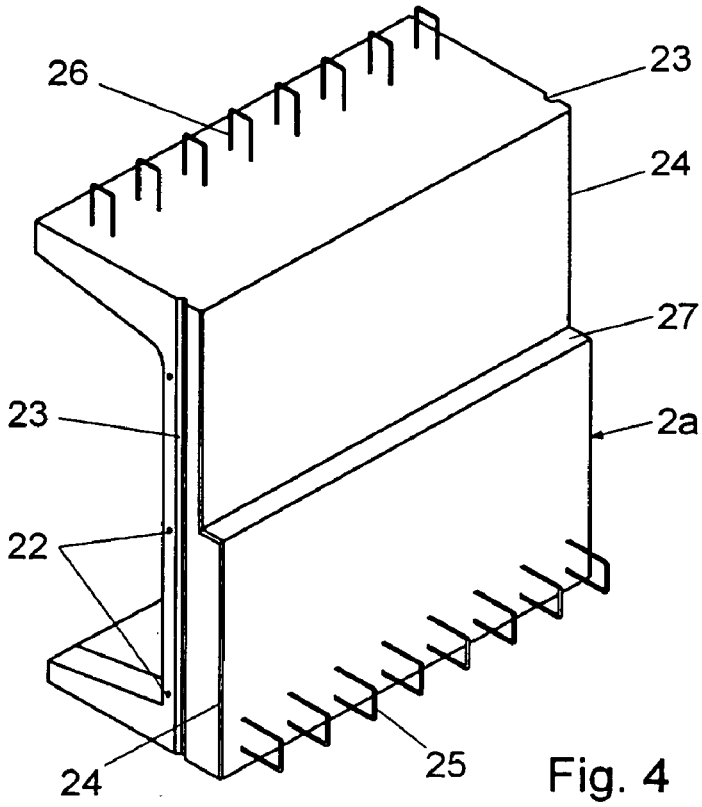
FIG. 4 shows a front perspective view of the prefabricated part of FIG. 3.

Parts (2*b* and 2*c*), similarly to part (2*a*) represented in FIGS. 3 and 4, have vertical reinforcement ribs (21) on the back, two of which match the side ends of the part. Said end vertical ribs (21) have horizontal holes (22) to assemble a threaded rod (3) with its corresponding lock nuts (31), so that successive parts (2*a*, 2*b*, 2*c*) can be fastened sideways, as indicated in FIG. 5.

Figure 5:
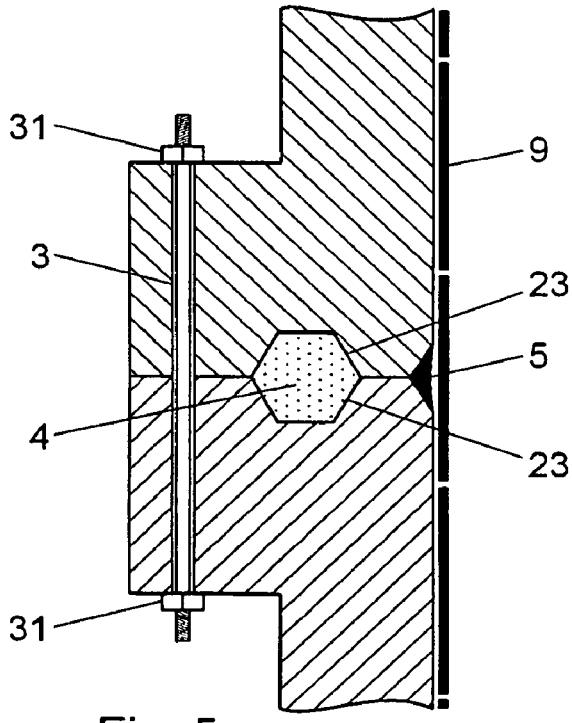
FIG. 5 shows an upper ground view of the opposite ends of two prefabricated concrete parts cross-sectioned by a horizontal plane, in which the side tightening means, the intermediate housing filled with concrete with expansive additives and the front notch formed by the bevels of said parts and covered by a joint sealing filler are shown.
Figure 6:
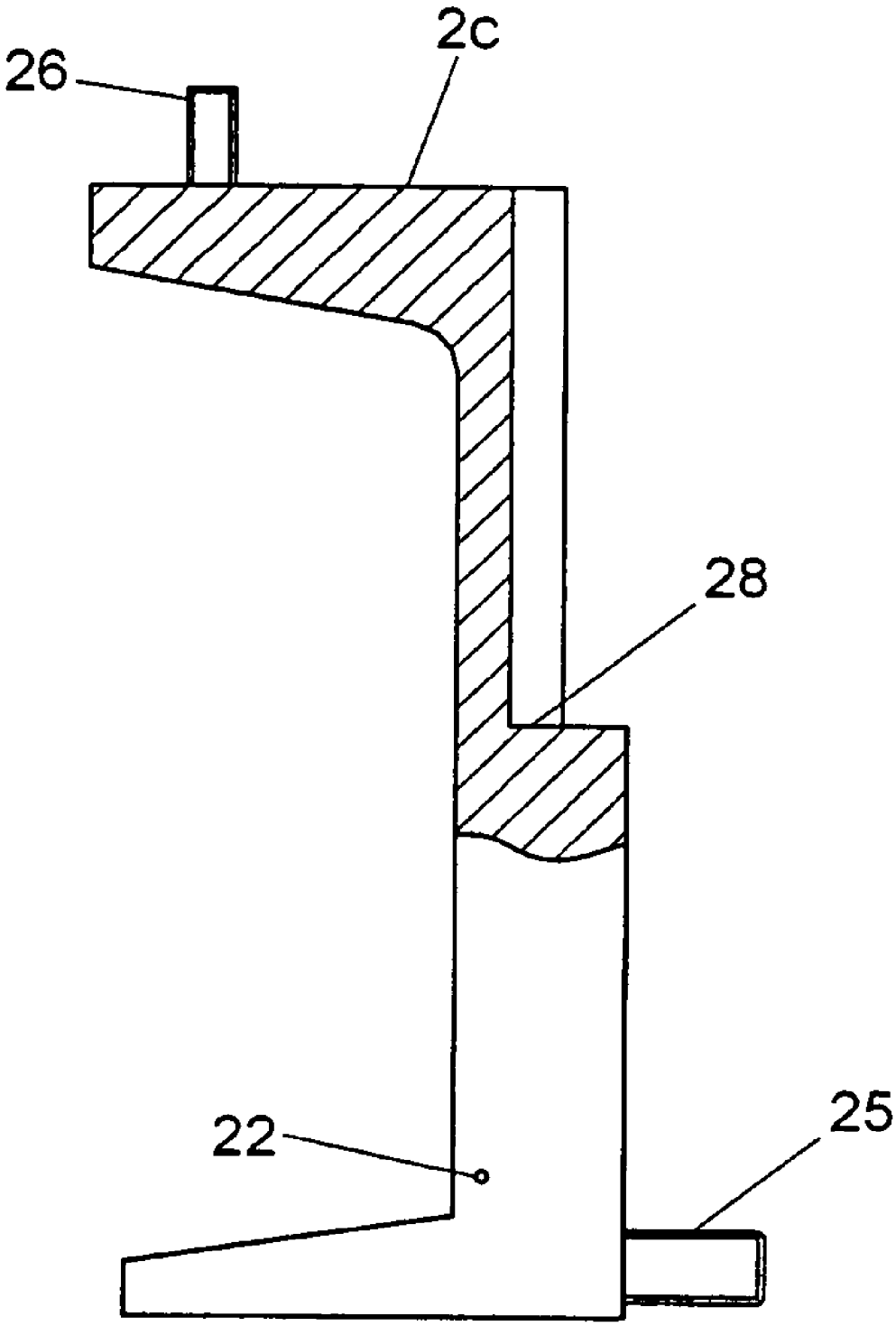
FIG. 6 shows a profile view of the prefabricated part provided with a side step used to form an access ladder, partially cross-sectioned by a vertical centre plane.

As can be observed in FIG. 5, the prefabricated parts ((2*a*, 2*b* and 2*c*) have vertical side channels (23), which define in the assembly position, a housing in which concrete filler with expansive additives is placed, which helps to join the aforementioned prefabricated reinforced concrete parts.

Said prefabricated parts (2*a*, 2*b* and 2*c*) have bevels (24), which define in the assembly position a front notch, which is filled (5) to seal the joint of the successive prefabricated parts.

The inside reinforcement of the prefabricated parts (2*a*, 2*b* and 2*c*) partially projects outwards forming tongues or clips (25) which project from the front/lower area of said prefabricated parts, and tongues or clips (26) which project from the top. These parts projecting from the reinforcement form elements which are embedded and totally covered by a second layer of concrete, which forms the bed (6) of the pool and by a perimeter ring which forms part of an upper perimeter finish of the pool wall, as indicated in FIG. 1.

The prefabricated parts (2*a*, 2*b* and 2*c*) have an intermediate step (27) on the front surface, which in the case of part (2*c*) goes inwards forming a wider indentation (28) enabling said prefabricated part (2*c*) to be used as an access ladder to the pool.

Figure 1:
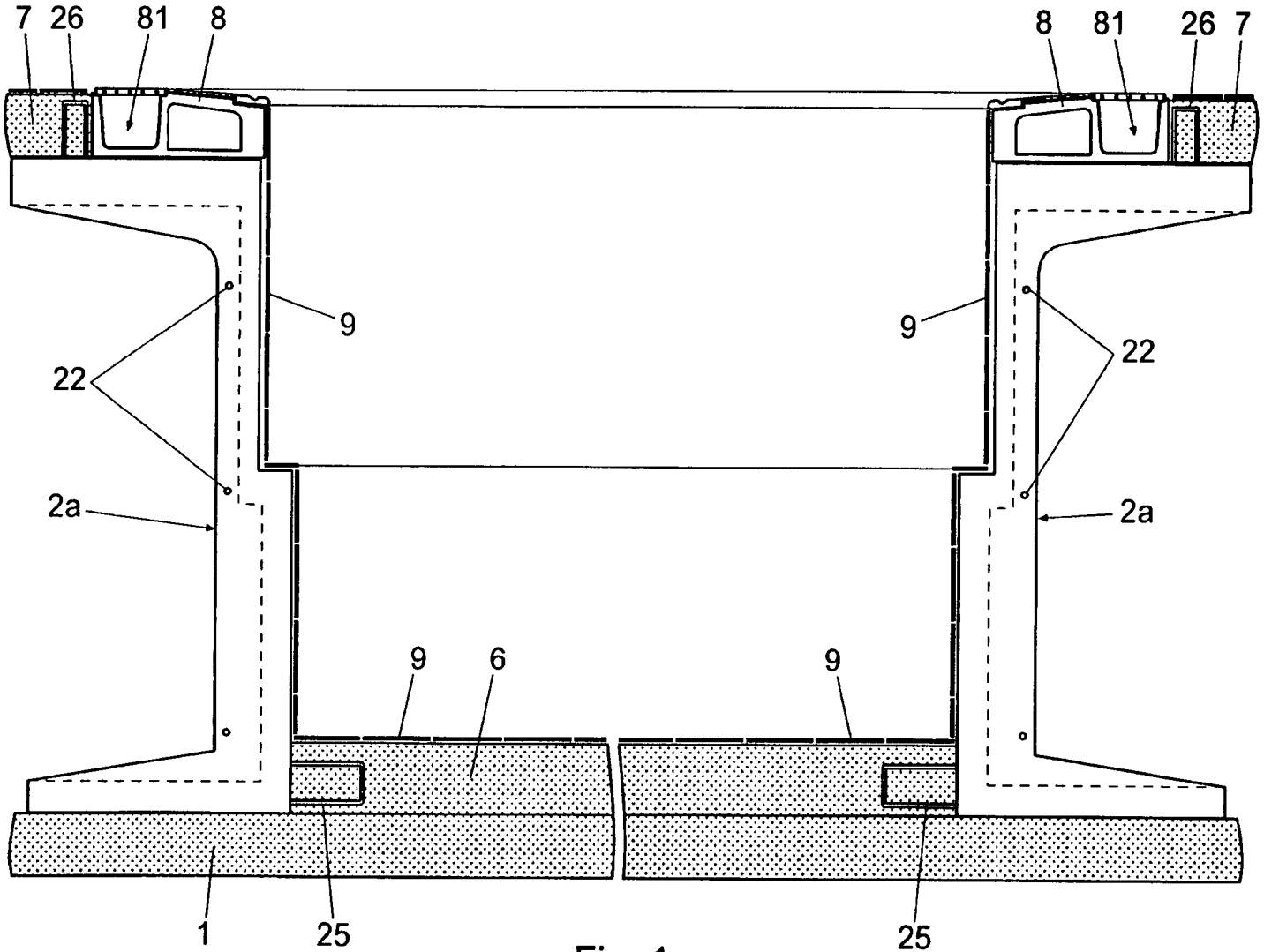
FIG. 1 shows an elevation view of the pool cross-sectioned by a vertical plane.

As can be observed in FIG. 1, the upper perimeter finish of the pool wall, can incorporate fluted parts (8), which form a channel (81) to collect water in overflow swimming pools.

Obviously, the concrete used in constructing the prefabricated parts (2*a*, 2*b* and 2*c*) will incorporate the additives necessary to guarantee total water tightness.

The inside finish of the pool is with tiles (9) applied directly on the prefabricated parts (2*a*, 2*b* and 2*c*) and on the bed (6).

Having sufficiently described the nature of the invention, together with an example of preferential manufacture, it is stated that materials, shape, size and lay-out of the described elements can be modified, as long as this does not alter the essential features of the invention, the claims to which are made below.

What is claimed is:

1. A Swimming Pool, of the type consisting of a side wall formed by prefabricated parts; comprising:

a first sheet or layer of concrete (1) forming the foundation, and which defines an upper horizontal surface, general "C" profile prefabricated reinforced concrete parts (2*a*, 2*b*, 2*c*), placed on 10 the foundation layer and which have;—tongues or clips (25, 26) of the reinforcement which partially project from the front/lower areas and from the upper area of the prefabricated parts,—at least two back ribs (21) directed vertically, placed matching the side ends of the parts (2*a*, 2*b*, 2*c*) and which have slightly horizontal holes (22) on which side tightening means (3, 31) are placed of the successive pairs of prefabricated parts,—15 vertical channels (23) defined in the opposite sides and which define between the successive parts (2*a*, 2*b*, 2*c*) a housing containing concrete filler (4) with expansive additives, and—vertical bevels (24) matching the edges defined by the front and side surfaces of parts (2*a*, 2*b*, 2*c*).

2. A swimming pool according to claim 1 wherein bevels (24) define a front notch in which a sealing filler (5) of the joint defined by the adjacent parts (2*a*, 2*b*, 2*c*) is placed.

3. A swimming pool according to claim 1 wherein a bed (6) formed by a second layer of concrete placed on the first layer of concrete (1) and which covers the tongues or clips (25) which project from the front/bottom area of the prefabricated parts (2*a*, 2*b*, 2*c*),—and upper perimeter finish (7, 8) of the side wall, and—a layer of tiles (9) applied directly on the front surface of the prefabricated parts 25(2*a*, 2*b*, 2*c*) and on the bed (6) or bottom of the pool.

4. A swimming pool, according to claim 1, wherein the upper perimeter finish has fluted parts (8) fastened onto the prefabricated reinforced concrete parts and a perimeter concrete ring (7), which covers the upper tongues or clips (26) of the reinforcement of prefabricated parts (2*a*, 2*b*, 2*c*).

5. A swimming pool, according to claim 1, wherein the side tightening means of the successive pairs of prefabricated parts (2*a*, 2*b*, 2*c*) consist of threaded rods (3) assembled as a bushing in the holes (22) adjacent to the prefabricated parts, and end lock nuts (31).

6. A swimming pool, according to claim 1, wherein the prefabricated parts (2*a*) have a straight configuration.

7. A swimming pool, according to claim 1, wherein the prefabricated parts (2*c*) form a corner.

8. A swimming pool, according to claim 1, wherein at an intermediate height, the prefabricated reinforced concrete parts (2*a*, 2*b*, 2*c*) have a step projecting towards the front or inside surface of the pool.

9. A method of manufacturing a swimming pool included in claim 6, comprising the steps of:

a) forming a flat foundation by applying a first layer of concrete (1);

b) placing on the set foundation prefabricated reinforced concrete parts (2*a*, 2*b*, 2*c*) placed sideways forming the side surface of the pool;

c) linking and side tightening of successive pairs of prefabricated parts by inserting in the holes of the back ribs the respective threaded rods (3) and the assembly and tightening of nuts (31);

d) filling the holes defined between the prefabricated parts (2*a*, 2*b*, 2*c*) vertical channels (23) with a concrete filler (4) with expansive additives;

e) sealing the front joints of the prefabricated parts by applying a sealer filler (5) 25 in the notches defined by bevels (24) of said prefabricated parts (2*a*, 2*b*, 2*c*);

f) f forming a bed or base (6) of the pool by a second layer of concrete which covers the front tongues or clips (25) of the prefabricated parts (2*a*, 2*b*, 2*c*);

g) the upper finish of the swimming pool by fastening fluted parts (8) on the prefabricated parts (2*a*, 2*b*, 2*c*) and building a perimeter ring (7) with concrete on the 30 upper tongues (26) of said parts (2*a*, 2*b*, 2*c*); and h) lining the inside surface of the pool by directly placing tiles (9) on the front surface of the prefabricated parts (2*a*, 2*b*, 2*c*) and the bed surface (6).

* * * * *